US008684052B2

(12) United States Patent
Breitenbach

(10) Patent No.: US 8,684,052 B2
(45) Date of Patent: Apr. 1, 2014

(54) DEVICE WITH A PROFILED RAIL AND AT LEAST ONE FASTENING ELEMENT

(75) Inventor: Jan Breitenbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 1519 days.

(21) Appl. No.: 11/813,431

(22) PCT Filed: Aug. 28, 2006

(86) PCT No.: PCT/EP2006/065715
§ 371 (c)(1),
(2), (4) Date: Jul. 6, 2007

(87) PCT Pub. No.: WO2007/048652
PCT Pub. Date: May 3, 2007

(65) Prior Publication Data

US 2008/0110529 A1 May 15, 2008

(30) Foreign Application Priority Data

Oct. 24, 2005 (DE) ..... 10 2005 050 783

(51) Int. Cl.
*B25H 1/00* (2006.01)

(52) U.S. Cl.
USPC ..... 144/286.1; 144/286.5

(58) Field of Classification Search
USPC ..... 144/285, 286.1, 286.5; 108/115, 116, 108/118, 12, 132, 131; 83/471.3; 269/139, 269/164, 319, 69; 182/181.1, 186.6
See application file for complete search history.

(56) References Cited

U.S. PATENT DOCUMENTS

| | | | | | |
|---|---|---|---|---|---|
| 4,527,786 | A | * | 7/1985 | Hsu | 269/154 |
| 5,018,562 | A | | 5/1991 | Adams | |
| 5,443,554 | A | | 8/1995 | Robert | |
| 5,626,321 | A | * | 5/1997 | Ulshafer, Jr. | 248/231.41 |
| 5,716,045 | A | | 2/1998 | Taylor | |
| 5,768,966 | A | | 6/1998 | Duginske | |
| 5,836,365 | A | * | 11/1998 | Derecktor | 144/287 |
| 5,884,681 | A | * | 3/1999 | Nickles | 144/329 |
| 5,988,243 | A | | 11/1999 | Ayala et al. | |
| 6,058,990 | A | * | 5/2000 | Kent | 144/286.5 |
| 6,293,176 | B1 | * | 9/2001 | Talesky | 83/438 |
| 6,334,743 | B1 | * | 1/2002 | Liao | 408/16 |
| 6,481,477 | B1 | | 11/2002 | Szymanski et al. | |
| D471,287 | S | * | 3/2003 | Sommerville et al. | D25/67 |
| 6,595,251 | B2 | * | 7/2003 | Ayala et al. | 144/286.1 |
| 6,748,987 | B2 | * | 6/2004 | Ayala et al. | 144/286.5 |
| 7,036,540 | B2 | * | 5/2006 | Welsh et al. | 144/286.1 |
| 7,201,192 | B2 | * | 4/2007 | Makropoulos | 144/286.5 |
| 7,210,510 | B2 | * | 5/2007 | Barclay deTolly | 144/286.1 |
| 7,222,648 | B2 | * | 5/2007 | Liu et al. | 144/286.5 |
| 7,458,403 | B2 | * | 12/2008 | Radermacher | 144/286.1 |
| 2003/0056631 | A1 | | 3/2003 | Duginske | |
| 2004/0221923 | A1 | | 11/2004 | Welsh et al. | |

FOREIGN PATENT DOCUMENTS

| | | |
|---|---|---|
| EP | 1 275 476 | 1/2003 |

* cited by examiner

*Primary Examiner* — David J. Walczak
*Assistant Examiner* — Jennifer C Chiang
(74) *Attorney, Agent, or Firm* — Michael J. Striker

(57) ABSTRACT

The invention relates to a device comprising a profiled rail (10) and at least one fastening element (12) for fixing a machine tool and/or a workpiece to the profiled rail (10). The fastening element (12) is provided with at least one clamping jaw (22, 24) and a clamping means (26) that is effectively connected to the clamping jaw (22) in order to brace the clamping jaw (22) with the profiled rail (10). According to the invention, the clamping means (26) is embodied as an eccentric lever.

10 Claims, 4 Drawing Sheets

DEVICE WITH A PROFILED RAIL AND AT LEAST ONE FASTENING ELEMENT

CROSS-REFERENCE TO RELATED APPLICATION

The invention described and claimed hereinbelow is also described in German Patent Application DE 10 2005 050 783.2 filed on Oct. 24, 2005. This German Patent Application, whose subject matter is incorporated here by reference, provides the basis for a claim of priority of invention under 35 U.S.C. 119(a)-(d).

BACKGROUND OF THE INVENTION

The present invention relates to a device with a profiled rod and at least one fastening element.

Publication US 2004/0221923 A1 makes known a device with a profiled rail and two fastening elements for mounting a machine tool and/or a work piece on the profiled rail. Each of the fastening elements includes two clamping jaws, and a first clamping jaw is operatively connected with a spring. The spring serves as clamping means for clamping the clamping jaw onto the profiled rail.

SUMMARY OF THE INVENTION

The present invention relates to a device with a profiled rail and at least one fastening element of a machine tool and/or a work piece on the profiled rail. The fastening element is provided to grip the sides of the profiled rail; it includes at least one clamping jaw and clamping means operatively connected with the clamping jaw for clamping the clamping jaw onto the profiled rail.

It is provided that the clamping means are designed as an eccentric lever.

By using leverage to produce a clamping force, a stable hold with a strong clamping force can be attained in a comfortable manner and, in particular, without the use of tools. Advantageously, the fastening element can be prevented from accidentally becoming detached from the profiled rail, which can be dangerous, and which can occur, e.g., with clamped connections produced by spring force. Safety risks can therefore be eliminated when mounting machine tools, in particular, such as circular saws, cross saws or mitre saws.

The eccentric lever can include an eccentric cam or a pin or bolt that is positioned eccentrically relative to a fixed swivel axis of the eccentric lever.

A particularly secure hold can be attained when the clamping means are provided to fix the clamping jaw in a clamped position in a form-fit manner. In this context, the term "provided" should be understood to also mean "designed" and "equipped". The clamped position of the clamping jaw is characterized, in particular, by a clamping surface of the clamping jaw bearing against a corresponding mounting surface of the profiled rail with a contact force or clamping force.

A particularly robust fastening element is obtainable when the clamping means are supported in the fastening element such that they are displaceable along a straight line. Highly stressed pivot axes can be prevented in particular.

When a maximum displacement travel of the clamping means is at least so great that the fastening element can be lifted off of the profiled rail when the clamping means are in a released position, the fastening means or machine tool can be connected with the profiled rail in a particularly rapid and convenient manner.

A particularly dust-resistant fastening device as can be attained using simple design means when the operative connection between the clamping jaw and the clamping means is produced by an eccentric cam integrally formed on the clamping means.

In an alternative embodiment of the present invention, the operative connection between the clamping jaw and the clamping means is produced by a connecting rod that is connected eccentrically with the clamping means. As a result, a transfer of force via a body of the fastening element can be prevented.

When the device includes safety locking means for securing the clamping jaw in a clamped position, the clamping means can be effectively prevented from becoming accidentally released.

When the safety locking means automatically engage in the clamping means when the clamped position is reached, it can be ensured that the device cannot be used without actuating the safety locking means. In particular, when the clamping jaw is fixed in its clamped position by the clamping means in a form-fit manner, the leverage of the clamping means can improve the effect of the safety locking means, and, in fact, compared with embodiments of the present invention with which the safety locking means engage in the clamping jaw directly.

In an alternative embodiment of the present invention, the safety locking means engage in the connecting rod.

When the device includes a second clamping jaw with a clamping surface designed as mirror image—relative to a plane of symmetry of the profiled rail—of a clamping surface of the first clamping jaw, it is possible to choose any orientation of the fastening element relative to the profiled rail. As a result, the device can be adapted to various applications in a more flexible manner. In addition, asymmetric wear can be prevented.

A particularly large variety of machine tools and/or work pieces can be mounted on the profiled rail using the fastening element when the device includes at least one threaded plate that is displaceable relative to a frame of the fastening element. By displacing the threaded plate, the fastening element can be adapted to various hole patterns in the machine tool and/or the work piece without the need to create additional holes.

Particularly easy installation of the fastening element on the machine tool and/or the work piece can be attained when the displaceable threaded plate is accessible from both sides of the frame of the fastening element, and/or when the frame includes an engagement recess in the region of the displaceable threaded plate. The device can form a complete, portable work bench when the profiled rail is equipped with collapsible support legs. User comfort can be enhanced further when the profiled rail is equipped with a handle.

When the profiled rail includes a holding device for holding a screw tool, transport and set-up of the device, e.g., at a work site, can be simplified.

When the profiled rail includes a fastening groove for mounting a machine tool and/or a work piece, the spectrum of applications for the profiled rail can be expanded.

Transport can be made even more comfortable when the profiled rail is equipped with a handle.

Further advantages result from the description of the drawing, below. Exemplary embodiments of the present invention are shown in the drawing. The drawing, the description and the claims contain numerous features in combination. One skilled in the art will also advantageously consider the features individually and combine them to form further reasonable combinations.

DESCRIPTION OF THE PREFERRED EMBODIMENTS

Figure 1:
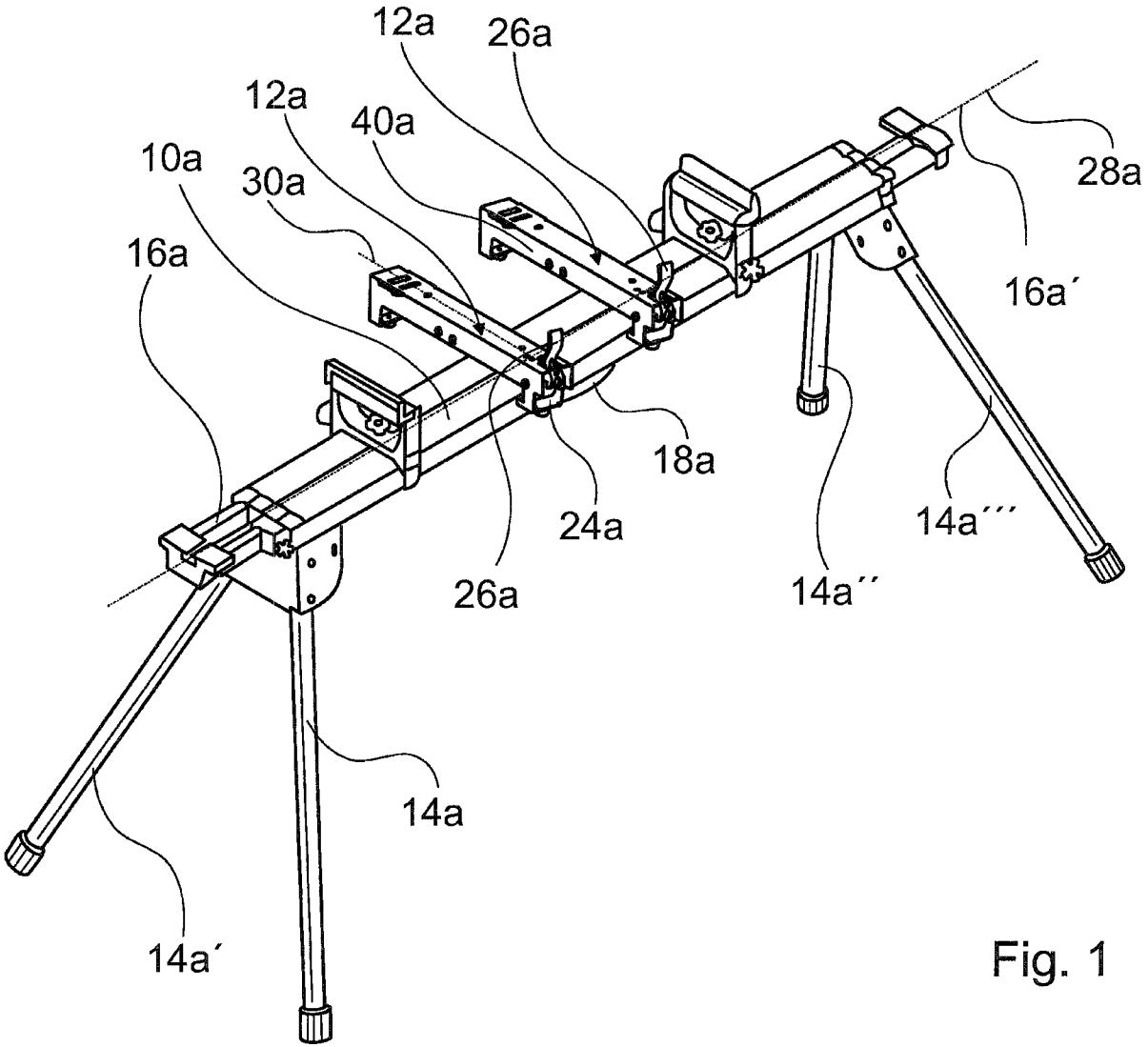
FIG. 1 shows a portable work bench with a profiled rail and two fastening elements.

FIG. 1 shows a portable work bench with a profiled rail 10*a* made of aluminium, which is equipped with collapsible support legs 14*a*-14*a*'", two extensions 16*a*, 16*a*', and a handle 18*a*. Extension 16*a* can be slid into profiled rail 10*a*, and support legs 14*a*-14*a*'" can be folded inward, thereby enabling the work bench to be transported as a compact unit. One of the support legs 14*a* is designed to be height-adjustable, in order to attain good stability on uneven ground.

Portable work bench includes two fastening elements 12*a*, 12*a*', which can be clamped onto profiled rail 10*a*. Any type of machine tool, particularly electrical machine tools, and work pieces can be screwed onto fastening elements 12*a*, 12*a*', or they can be connected with fastening elements 12*a*, 12*a*' in any other manner deemed suitable by one skilled in the art. The machine tool or the work piece can then be connected with profiled rail 10*a* comfortably and rapidly using fastening elements 12*a*, 12*a*'.

Fastening element 12*a* includes—on its underside 20*a* facing profiled rail 10*a*—a first, movable clamping jaw 22*a* and a second, fixed clamping jaw 24*a*. Clamping means 26*a* operatively connected with first, movable clamping jaw 22*a* are located at one end of longitudinal fastening element 12*a* and are designed as a pivotable eccentric lever capable of pivoting around a pivot axis 32*a* extending parallel to a longitudinal axis 28*a* of profiled rail 10*a*.

Figure 2:
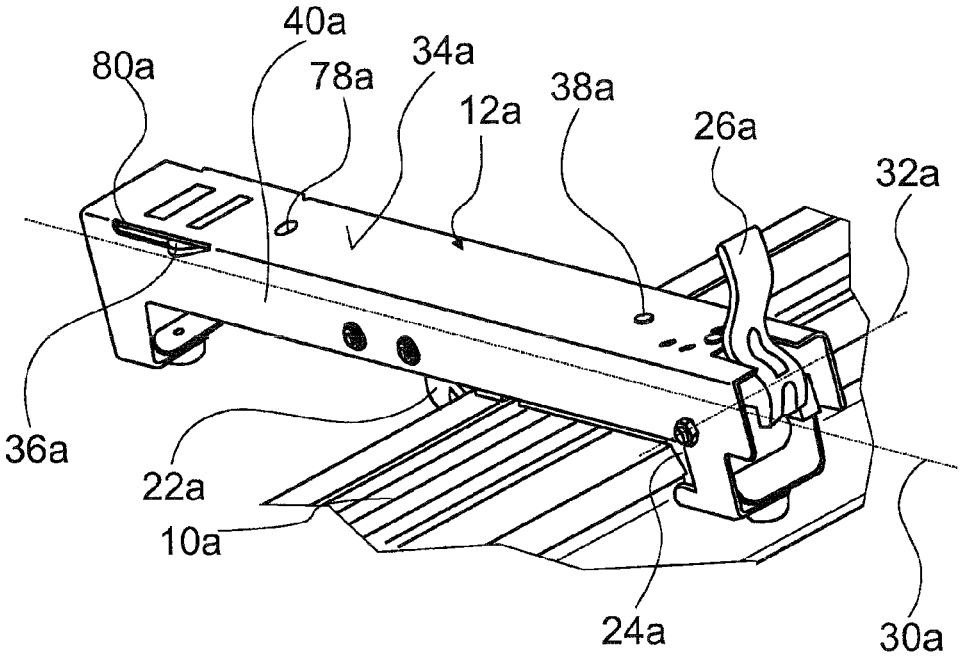
FIG. 2 shows one of the fastening elements in FIG. 1.
Figure 3:
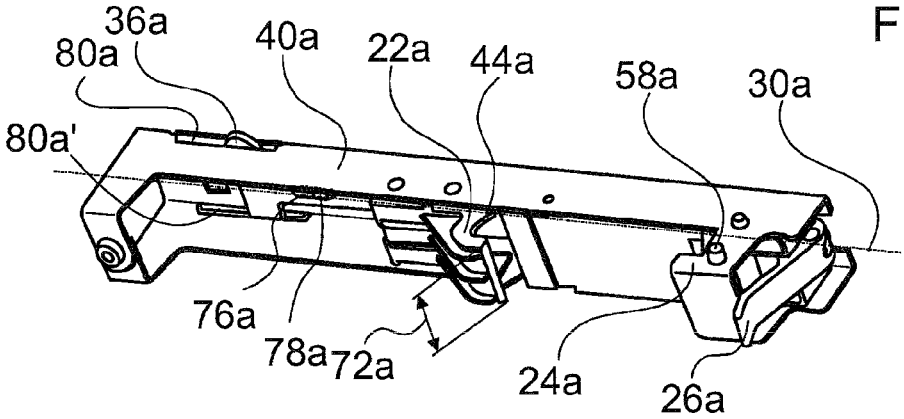
FIG. 3 shows the fastening element in FIG. 2, in a view diagonally from below.

A top side 34*a* of fastening element 12*a* that faces away from profiled rail 10*a* when in the installed state includes a first threaded plate 36*a* capable of being displaced along longitudinal axis 30*a* of fastening element 12*a* and along longitudinal axis 28*a* of profiled rail 10*a*, and a second threaded plate 38*a*, which is fixed in position relative to a frame 40*a* of fastening element 12*a* (FIG. 2). Displaceable threaded plate 36*a* is connected via a slot 76*a* and a bolt 78*a* engaged in slot 76*a* with frame 40*a*, and has a T-shaped design overall (FIG. 3). The ends of the crossbar of the T shape extend laterally through slits 80*a*, 80*a*' in frame 40*a*. As a result, the mobility of threaded plate 36*a* relative to a swivel motion around bolt 78*a* is limited by the ends of slits 80*a*, 80*a*'. The amount of play that threaded plate 36*a* has in the direction of longitudinal axis 30*a* of fastening element 12*a* is limited by the length of slot 76*a*. The machine tool or work piece to be mounted can be screwed together with both threaded plates 36*a*, 38*a* via bore holes. The user can thereby adapt the position of first, displaceable threaded plate 36*a* to a hole pattern of the machine tool or the work piece. Due to the threads provided in threaded plates 36*a*, 38*a*, bolts—which could easily become lost—need not be used when screwing the machine tool into place. In a cutting plane extending transversely to a longitudinal axis 30*a* of fastening element 12*a*, the latter has a U-shaped profile that opens downward in the direction toward profiled rail 10*a*, thereby enabling threaded plates 36*a*, 38*a* located in the region of top side 34*a* of fastening element 12*a* to be accessed freely from below to screw the machine tool or the work piece into place.

Figure 6:
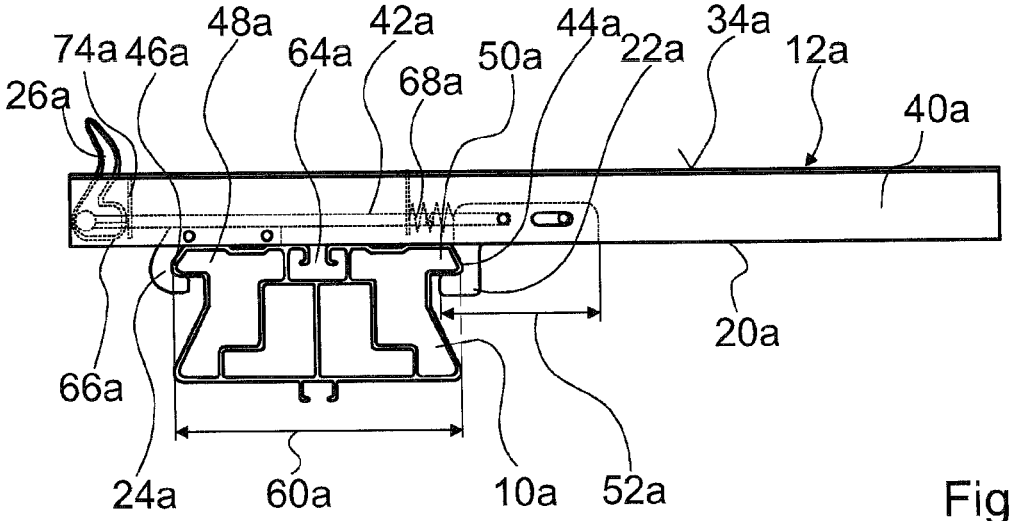
FIG. 6 shows the profiled rail, the fastening element, and clamping means in a clamped position.
Figure 7:
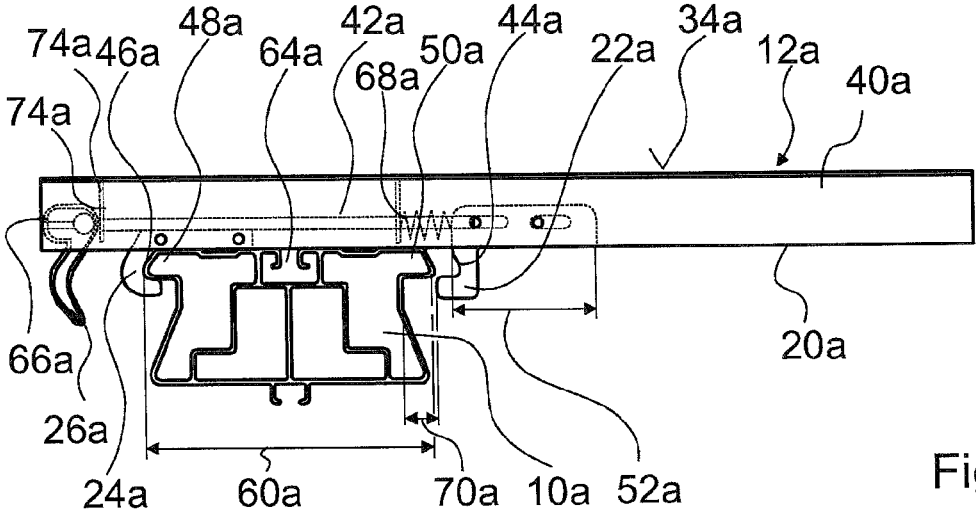
FIG. 7 shows the profiled rail, the fastening element, and clamping means in a released position.

First clamping jaw 22*a* is supported in fastening element 12*a* such that it can be displaced along a straight line, and it is connected with clamping means 26*a* via a connecting rod 42*a*. Connecting rod 42*a* is connected with clamping means 26*a* via a bolt such that it can pivot around pivot axis 32*a*. Clamping means 26*a* include an eccentric cam 66*a*, which bears against a support tab 74*a* of frame 40*a*, thereby enabling a swiveling motion of clamping means 26*a* to be transferred—by eccentric cam 66*a* gliding over support tab 74*a*—into a reciprocating motion of connecting rod 42*a* and clamping jaw 22*a* connected via a connecting bolt with connecting rod 42*a* (FIGS. 6 and 7). A return spring 68*a* automatically returns clamping jaw 22*a* from an intermediate position to the opened position and, in the opened position, it generates a contact force of eccentric cam 66*a* on support tab 74*a*. To attain horizontal guidance and a vertical hold of connecting rod 42*a*, the latter is guided through a hole—which is not shown explicitly here—in support tab 74*a*.

Clamping jaws 22*a*, 24*a* include clamping surfaces 44*a*, 46*a* designed as mirror images of each other, which bear against fastening ridges 48*a*, 50*a* of profiled rail 10*a* in a clamped position (FIG. 6). Clamping surfaces 44*a*, 46*a* grip partially around fastening ridges 48*a*, 50*a*, so that fastening element 12*a*—when in the clamped position—is connected in a form-fit manner with profiled rail 10*a* in a vertical direction and in a direction that extends perpendicularly to longitudinal axis 28*a* of profiled rail 10*a* and to longitudinal axis 30*a* of fastening elements 12*a*. A width 72*a* (FIG. 3) of clamping surfaces 44*a*, 46*a* along longitudinal axis 28*a* of profiled rail 10*a* is a few centimeters, particularly more than three centimeters, so that clamping jaws 22*a*, 24*a* automatically become oriented at a right angle with profiled rail 10*a* when they are clamped thereon. Given that a length 52*a* of first, movable clamping jaw 22*a* is greater than width 72*a* of clamping surface 44*a*, 46*a* and, in particular, is greater than five centimeters, clamping jaw 22*a* can be effectively prevented from tilting within frame 40*a* of fastening element 12*a* via a large mounting surface, thereby ensuring parallelism between clamping jaw 22*a* and fastening element 12*a*, and therefore ensuring that a right angle is formed between longitudinal axis 28*a* of profiled rail 10*a* and longitudinal axis 30*a* of fastening element 12*a* in the clamped state.

Figure 4:
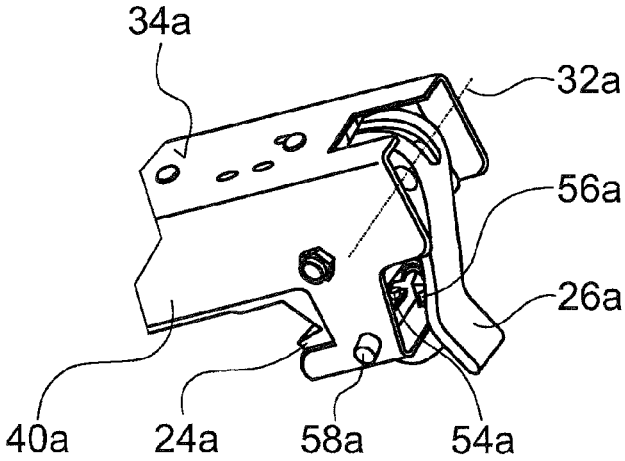
FIG. 4 shows clamping means of the fastening element and safety locking means, in a detailed view.

Safety locking means 54*a* with an integrally formed pin 56*a*, which are spring-loaded, rod-shaped, and displaceable parallel to longitudinal axis 28*a* of profiled rail 10*a*, are located in the region of clamping means 26*a*, and they automatically engage in clamping means 26*a* when clamping means 26*a* reach the clamped position (FIG. 4).

Shortly before the clamped position is reached, the reciprocating motion of connecting rod 42*a* passes an apex, so that clamping means 26*a* fix clamping jaw 22*a* in the clamped position in a form-fit manner. In the clamped position, a bore hole in clamping means 26*a* overlaps a pin 56*a* of safety locking means 54*a*, so that the latter automatically snaps into place and engages in clamping means 26*a*. To release clamping means 26*a*, a user can push safety locking means 54*a* back against the force of a spring by pressing on an end 58*a* of safety locking means 54, thereby allowing clamping means 26*a* to be released.

In an alternative embodiment of the present invention, the safety locking means engage in connecting rod 42*a*.

In a released configuration, in which clamping surfaces 44*a*, 46*a* are further away from each other—by displacement travel 70*a* (FIG. 7)—than in the clamped position, a distance between clamping surfaces 44*a*, 46*a* is at a maximum and exceeds a maximum width 60*a* between fastening ridges 48*a*, 50*a* of profiled rail 10*a*, thereby enabling the machine tool and/or work piece to be lifted—together with fastening elements 12*a*, 12*a*'—in a vertical direction off of profiled rail 10*a*. Similarly, the machine tool and/or work piece can be placed on profiled rail 10*a* in the vertical direction when clamping means 26*a* are released.

Figure 5:
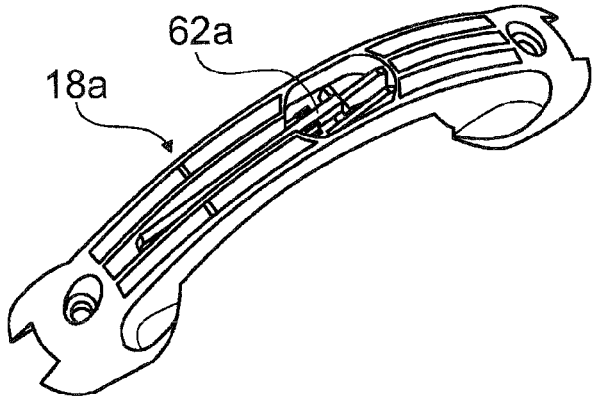
FIG. 5 shows a handle of the profiled rail in FIG. 1.

FIG. 5 shows a handle 18*a*, which is screwed onto profiled rail 10*a* from below. Handle 18*a* is designed as a plastic, injection-molded part, and simultaneously serves as a retaining means for holding a screw tool 62*a*, i.e., an Allen wrench. On a top side that extends horizontally in the installed state, profiled rail 10*a* includes a fastening groove 64*a* for fastening machine tools with appropriate clamp-connection means. Fastening groove 64*a* can be used as an alternative to fastening elements 12*a*, 12*a'*.

Figure 8:
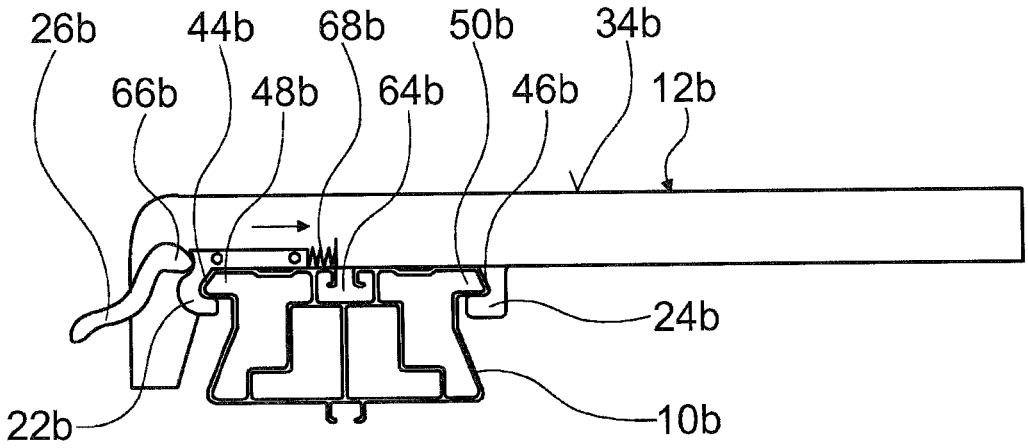
FIG. 8 shows a profiled rail and an alternative fastening element, in a clamped
Figure 9:
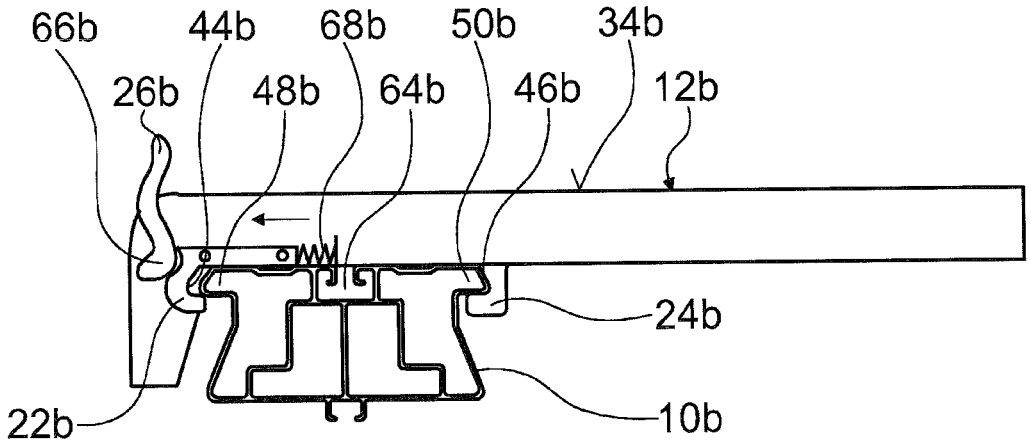
FIG. 9 shows the profiled rail and the fastening element in FIG. 8 in a released position.

FIGS. 8 and 9 show an alternative embodiment of the present invention. The description mainly addresses the differences between the exemplary embodiments shown in FIGS. 1 through 7. Similar features are labeled with the same reference numerals. To distinguish the exemplary embodiments from each other, the reference numerals are appended with the letters "a" and "b".

An operative connection that exists between clamping means 26*b* and a first, movable clamping jaw 22*b* is generated by an eccentric cam 66*b* integrally formed on clamping means 26*b*; eccentric cam 66*b* glides along a corresponding mounting surface of clamping jaw 22*b*. For clamping, clamping jaw 22*b* is pressed onto a profiled rail 10*b* in the longitudinal direction of a fastening element 12*b* (FIG. 8). When clamping means 26*b* are released, a return spring 68*b* moves clamping jaw 22*b* away from profiled rail 10*b*, so that fastening element 12*b* can be lifted off of profiled rail 10*b* along with the machine tool screwed in place thereon.

What is claimed is:

1. A device for mounting a machine tool and/or a workpiece, comprising a profiled rail; and of at least one fastening element for mounting the machine tool on the profiled rail, wherein the fastening element is provided with at least one clamping jaw and clamping means operatively connected with the clamping jaw to clamp the clamping jaw onto the profiled rail, wherein the clamping means are an eccentric lever, and wherein the clamping jaw is supported in the fastening element displaceably along a straight line in a direction of a longitudinal axis of the fastening element.

2. The device as recited in claim 1, wherein the clamping means are arranged to hold the clamping jaw in a clamped position in a form-fit manner.

3. The device as recited in claim 1, wherein the clamping jaw is displaceable over a maximum displacement travel of which is at least so great that the fastening element is lifted off of the profiled rail when the clamping jaw is in a released position.

4. The device as recited in claim 1, wherein an eccentric cam is provided which produces the operative connection between the clamping jaw and the clamping means and is integrally formed on the clamping means.

5. The device as recited in claim 1, wherein a connecting rod is provided which produces the operative connection between the clamping jaw and the clamping means and is connected eccentrically with the clamping means.

6. The device as recited in claim 1, wherein a second clamping jaw is provided with a clamping surface designed as a mirror image—when considered relative to a plane of symmetry of the profiled rail of a clamping surface of the first clamping jaw.

7. The device as recited in claim 1, wherein the profiled rail is equipped with collapsible support legs.

8. The device as recited in claim 1, wherein the profiled rail is equipped with a holding device for holding a screw tool.

9. The device as recited in claim 1, wherein the profiled rail includes a fastening groove for attaching a machine tool and/or a work piece.

10. The device as recited in claim 1, wherein the profiled rail includes a handle.

* * * * *